US008146833B2

(12) United States Patent
Song et al.

(10) Patent No.: US 8,146,833 B2
(45) Date of Patent: Apr. 3, 2012

(54) METHOD TO CONTROL SLEEP OPERATION OF AIR CONDITIONER

(75) Inventors: Myung Seob Song, Hwaseong-si (KR); Hyung Chel Kim, Busan (KR); Kook Jeong Seo, Yongin-si (KR); Seung Chul Shin, Suwon-si (KR); Yong Gak Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 943 days.

(21) Appl. No.: 11/937,757

(22) Filed: Nov. 9, 2007

(65) Prior Publication Data

US 2008/0295531 A1 Dec. 4, 2008

(30) Foreign Application Priority Data

May 29, 2007 (KR) ..... 10-2007-0052074
Nov. 6, 2007 (KR) ..... 10-2007-0112564

(51) Int. Cl.
*G05D 23/19* (2006.01)
*G05D 23/00* (2006.01)

(52) U.S. Cl. ..... 236/46 C; 236/1 C; 236/46 R; 236/91 D; 236/91 R; 62/157

(58) Field of Classification Search ..... 62/157; 236/91 D, 1 C, 46 C, 91 R
See application file for complete search history.

(56) References Cited

U.S. PATENT DOCUMENTS

2007/0169490 A1 * 7/2007 Hiura et al. ..... 62/157

FOREIGN PATENT DOCUMENTS

| | | | |
|---|---|---|---|
| EP | 1811238 | A2 * | 7/2007 |
| JP | 9-170797 | | 6/1997 |
| JP | 9-303840 | | 11/1997 |
| JP | 2001-201136 | | 7/2001 |
| JP | 2004-92918 | | 3/2004 |
| JP | 2006317074 | A * | 11/2006 |
| KR | 1994-0010703 | | 10/1994 |
| KR | 2002-0002796 | | 1/2002 |
| KR | 10-0723947 | | 5/2007 |

OTHER PUBLICATIONS

European Search Report for corresponding European Patent Application No. EP08155017 dated Sep. 22, 2008, 7 pgs (In English).
Chinese Office Action issued Oct. 10, 2011 in corresponding Chinese Patent Application No. 200810092267.2.

* cited by examiner

*Primary Examiner* — Marc Norman
*Assistant Examiner* — Jonathan Bradford
(74) *Attorney, Agent, or Firm* — Staas & Halsey LLP

(57) ABSTRACT

A method to control the sleep operation of an air conditioner is provided. The method includes determining whether or not a sleep operation is activated and sequentially performing a plurality of sub-modes of the sleep operation when the sleep operation is activated.

25 Claims, 4 Drawing Sheets

METHOD TO CONTROL SLEEP OPERATION OF AIR CONDITIONER

CROSS-REFERENCE TO RELATED APPLICATION

This application claims the benefit of Korean Patent Application No. 2007-0052074, filed on May 29, 2007 in the Korean Intellectual Property Office, the disclosure of which is incorporated herein by reference.

BACKGROUND OF THE INVENTION

1. Field of the Invention

The present invention relates to a method to control a sleep operation of an air conditioner, and more particularly, to a method to control a sleep operation of an air conditioner in which an indoor temperature is automatically changed in the sleep operation to allow the user to sleep soundly.

2. Description of the Related Art

A conventional air conditioner performs cooling and heating operations to cool and heat indoor air to keep it at a target indoor temperature selected by the user, thereby providing a comfortable room environment to the user. However, when the user sleeps during the cooling operation, they feel cold after a certain time elapses from the start of the cooling operation since the air conditioner operates with only the initially set target indoor temperature throughout the cooling operation and feel hot if the cooling operation is turned off, thereby failing to provide a comfortable sleep environment. On the other hand, when the user sleeps during the heating operation, they feel hot after a certain time elapses from the start of the heating operation since the air conditioner operates with only the initially set target indoor temperature throughout the heating operation and feel cold if the heating operation is turned off, thereby failing to provide a comfortable sleep environment.

FIG. 1 illustrates the characteristics of sleep states in which non-REM and REM sleep periodically alternate. As shown in FIG. 1, every human being alternately undergoes non-REM and REM sleep 4 or 5 times at intervals of about 90 minutes in a night. It can be seen from FIG. 1 that the deepest sleep is a non-REM sleep immediately after they fall asleep. The cold or hot feeling and the metabolic rate of the human being depend on the amount of heat generated from the skin. The human being feels colder as the metabolic rate decreases. FIG. 2 illustrates the characteristics of changes in the metabolic rate of human beings until they wake up after falling asleep. After they fall asleep, the metabolic rate of human beings is reduced to make them fall into a non-REM sleep as shown in FIG. 2. When they fall into a deep sleep from a shallow sleep, the body temperature of human beings is significantly reduced, causing serious perspiration. The perspiration causes the human being to feel hot and uncomfortable, thereby making it difficult to fall into a deep sleep.

To overcome these problems, Japanese Patent Application Publication No. 2004-92918 suggested an air conditioner which reduces the indoor temperature to be lower than a target indoor temperature set by the user at an initial stage in a preset sleep operation duration to allow them to quickly fall asleep, taking into consideration the sleep state characteristics of FIG. 1 and the changes in the metabolic rate of human beings during sleep. When the user has fallen asleep, their metabolic rate and activity is reduced so that they easily feel cold. Therefore, after the user falls asleep, the air conditioner gradually increases the indoor temperature to allow the user to sleep soundly.

However, this conventional method to control a sleep operation of an air conditioner does not take into consideration the sleep operation duration desired by the user and performs sleep operation control based on 8 hours which is the average sleep time, thereby failing to achieve efficient sleep operation control.

In addition, in the intermediate and final stages of the sleep operation, the indoor temperature becomes higher than the preset target temperature to increase the skin temperature of the user, thereby disturbing their sound sleep.

Further, the conventional air conditioner provides the sleep operation only for cooling, thereby failing to satisfy the user's desire for the sleep operation for heating.

SUMMARY OF THE INVENTION

Therefore, it is an aspect of the invention to provide a method to control a sleep operation of an air conditioner, wherein an indoor temperature is automatically changed in the sleep operation to allow the user to sleep soundly.

Additional aspects and/or advantages of the invention will be set forth in part in the description which follows and, in part, will be obvious from the description, or may be learned by practice of the invention.

The foregoing and/or other aspects of the present invention may be achieved by providing a method to control a sleep operation of an air conditioner, the method including determining whether or not a sleep operation is activated and sequentially performing a plurality of sub-modes of the sleep operation if the sleep operation is activated.

The plurality of sub-modes include a falling-asleep mode to reduce an indoor temperature to be lower than a target indoor temperature by a first level and a waking mode to increase the indoor temperature to be higher than the target indoor temperature by a second level.

The plurality of sub-modes further include a deep sleep mode to increase the indoor temperature to be higher than the target indoor temperature by the first level and then to reduce the indoor temperature back to the target indoor temperature periodically during cooling operation.

The plurality of sub-modes further include a deep sleep mode to increase the indoor temperature to the target indoor temperature after maintaining the indoor temperature at a level, which is lower than the target indoor temperature by the first level, during heating operation.

The deep sleep mode includes repeating an operation to reduce, when the indoor temperature has reached the target indoor temperature, the indoor temperature back to a temperature, which is lower than the target indoor temperature by the second level, and then to increase the indoor temperature back to the target indoor temperature.

An operation duration of the deep sleep mode is determined according to a duration of the sleep operation.

The second level is higher than the first level during cooling operation.

In the falling-asleep mode during cooling operation, when a sleep operation command is input, the air conditioner immediately operates with a temperature which is lower than the target indoor temperature by the first level.

The second level is lower than the first level during heating operation.

In the falling-asleep mode during heating operation, when a sleep operation command is input, the air conditioner operates with the target indoor temperature for a specific period of time and then operates with a temperature which is lower than the target indoor temperature by the first level.

The foregoing and/or other aspects of the present invention may also be achieved by providing a method to control a sleep operation of an air conditioner when the air conditioner is in cooling operation, the method including a falling-asleep mode to maintain an indoor temperature below a target indoor temperature until a first reference time elapses after the sleep operation starts, a deep sleep mode to increase, after the first reference time elapses, the indoor temperature to be higher than the target indoor temperature and then to reduce the indoor temperature back to the target indoor temperature periodically, and a waking mode to maintain the indoor temperature above the target indoor temperature for the first reference time before the sleep operation is terminated.

The first reference time is 1 hour.

The target indoor temperature is set within a range from 24□ to 27□.

The indoor temperature is maintained below the target indoor temperature by 2□ until the first reference time elapses from the start of the sleep operation, the indoor temperature is increased to be 2□ higher than the target indoor temperature and then reduced back to the target indoor temperature periodically after the first reference time elapses, and the indoor temperature is maintained above the target indoor temperature by 2.5-3□ for the first reference time before the sleep operation is terminated.

The foregoing and/or other aspects of the present invention may also be achieved by providing a method to control a sleep operation of an air conditioner when the air conditioner is in heating operation, the method including maintaining an indoor temperature below a target indoor temperature by a first level until a first reference time elapses after the sleep operation starts, and increasing, after the first reference time elapses, the indoor temperature to be higher than the target indoor temperature by a second level during a remaining time of the sleep operation.

The target indoor temperature is set within a range from 22□ to 25□.

The first level is 2□ and the second level is 1□.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
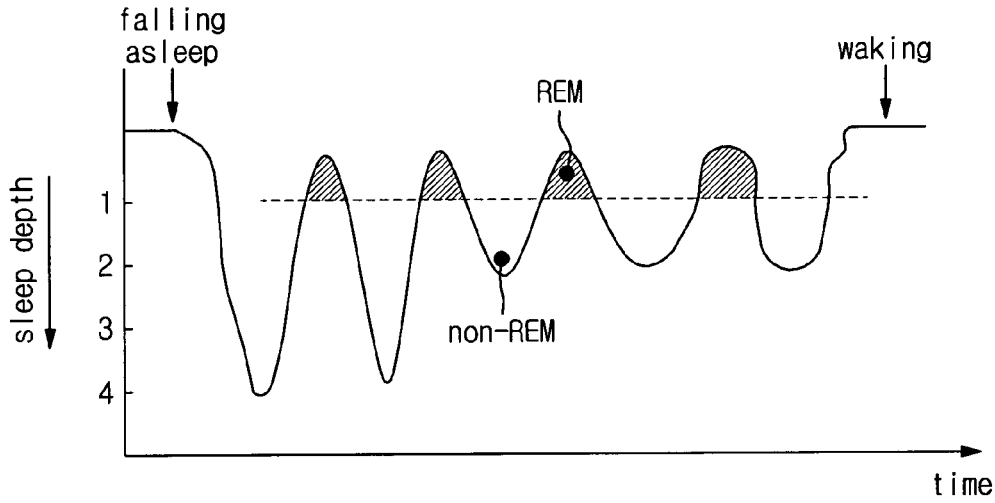
FIG. 1 illustrates the characteristics of sleep states in which non-REM and REM sleep periodically alternate.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
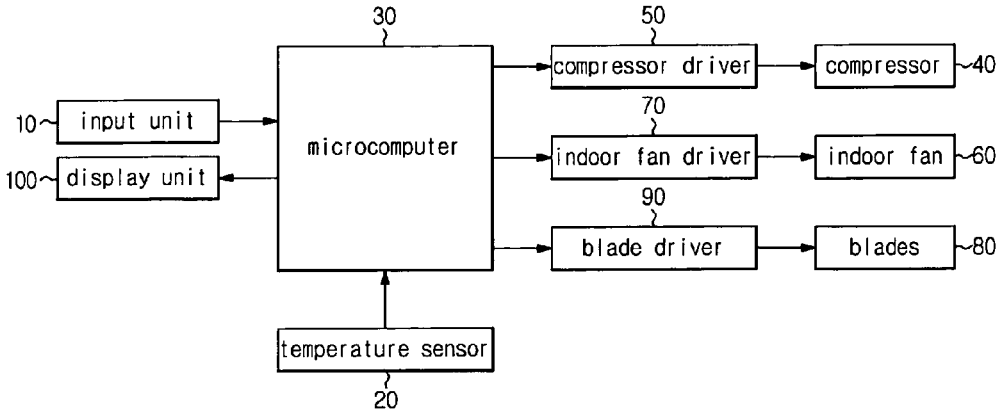
FIG. 3 is a block diagram of an air conditioner according to an embodiment of the invention.

As shown in FIG. 3, an air conditioner according to an embodiment of the invention includes an input unit 10, a temperature sensor 20, and a microcomputer 30. The input unit 10 receives operation information such as a cooling or heating operating mode, a sleep operation duration, and a target indoor temperature from a user. The temperature sensor 20 measures indoor temperature. The microcomputer 30 controls the sleep operation according to the operation information received from the input unit 10. The air conditioner further includes a compressor 40, a compressor driver 50, an indoor fan 60, an indoor fan driver 70, blades 80, and a blade driver 90. The compressor 40 discharges high-temperature refrigerant. The compressor driver 50 drives the compressor 40. The indoor fan 60 blows air, which has undergone heat exchange through an indoor heat exchanger, into the room. The indoor fan driver 70 drives the indoor fan 60. The blades 80 control the flow of discharged air. The blade driver 90 drives the blades 80.

The microcomputer 30 controls each driver according to received operation information to control the sleep operation of the air conditioner. When a sleep operation starts, the microcomputer 30 receives an indoor temperature through the temperature sensor 20 and controls the indoor temperature using a sleep operation algorithm according to each operation mode.

If the user inputs a too high or too low target indoor temperature, they feel hot or cold during sleep. To prevent this, during cooling operation, the microcomputer 30 causes a display unit 100 to display information requesting the user to enter the target indoor temperature within a range of 24 to 27° C. On the other hand, during heating operation, the microcomputer 30 causes a display unit 100 to display information requesting the user to enter the target indoor temperature within a range of 22 to 25° C. The reason why the target indoor temperature range is different depending on the operation mode is that the human body reacts differently to seasonal temperature characteristics. For example, human beings are susceptible to diseases such as the cold if the difference between indoor and outdoor temperatures is too high in summer or winter. Thus, it is desirable that a target indoor temperature during sleep operation of the air conditioner in summer be set to be higher than that of winter by a predetermined level.

The sleep operation is divided into three sub-modes with different operation durations and different indoor temperatures. The sub-modes include a falling-asleep mode in which the indoor temperature is reduced to allow the user to quickly fall asleep, a deep sleep mode in which the indoor temperature is controlled to allow the user to fall into a deep sleep, and a waking mode in which the indoor temperature is controlled to increase the body temperature of the user before they wake up.

The operation durations of the falling-asleep mode and the waking mode are preset in the microcomputer 30 and the operation duration of the deep sleep mode is set to be equal to a time left after subtraction of the sum of the operation durations of the falling-asleep mode and the waking mode from a sleep operation duration input by the user. For example, the operation duration of the deep sleep mode (the second section) is 6 hours if each of the preset operation durations of the falling-asleep mode and the waking mode is 1 hour and the sleep operation duration input by the user is 8 hours, whereas it is 7 hours if each of the preset operation durations of the falling-asleep mode and the waking mode is 1 hour and the sleep operation duration input by the user is 9 hours.

Figure 2:
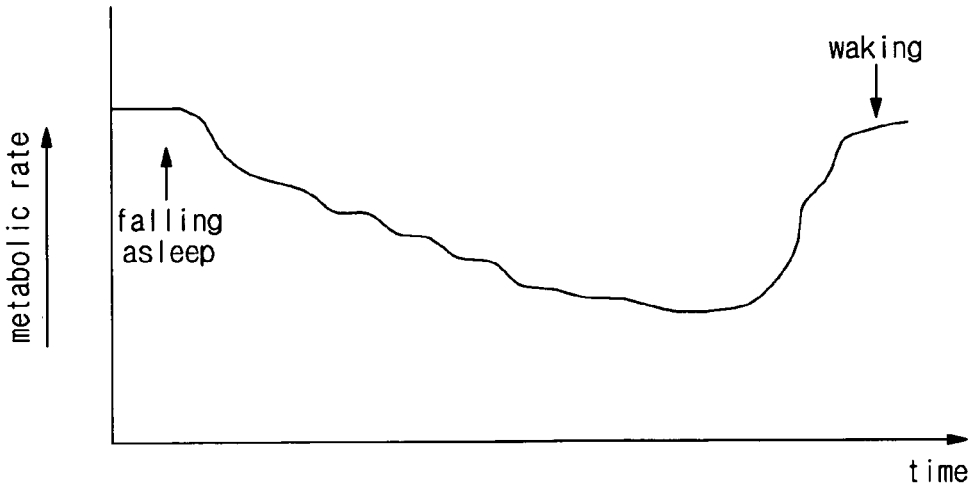
FIG. 2 illustrates the characteristics of changes in the metabolic rate of human beings until they wake up after falling asleep.

The target indoor temperature data of each sub-mode is set to be different depending on the operation mode in the microcomputer 30. The target indoor temperature data is set based on seasonal temperature characteristics and changes in the body temperature in sleep cycles of human beings shown in FIGS. 1 and 2.

Target indoor temperature data for the falling-asleep mode of the cooling operation is set to reduce the indoor temperature for a specific time in the initial stage of the sleep operation to allow the user to fall into a deepest sleep (3rd and 4th stages of Non-REM sleep). When the user has fallen asleep, their metabolic rate and activity is significantly reduced so that they easily feel cold. Therefore, target indoor temperature data for the deep sleep mode is set to increase the indoor temperature by a specific level in order to provide the user with a comfortable sleep environment in the deep sleep mode. The increase in the indoor temperature may make the user feel hot, thereby disturbing their comfortable sleep, so that the target indoor temperature data for the deep sleep mode is set to repeatedly reduce the indoor temperature back to the target indoor temperature initially input by the user. Finally, if the sleep operation is terminated and the user wakes up, then their body temperature is low and their metabolic activity is low. Therefore, target indoor temperature data for the waking mode is set to further increase the indoor temperature by a specific level in order to increase the body temperature of the user for a specific time before the sleep operation is terminated.

Target indoor temperature data for the falling-asleep mode of the heating operation is set to reduce the indoor temperature for a specific time in the initial stage of the sleep operation to allow the user to fall into a deepest sleep (3rd and 4th stages of Non-REM sleep). Since the indoor temperature in winter is often lower than the target indoor temperature input by the user, the indoor temperature in the falling-asleep mode of the heating operation is reduced after the heating operation is performed to maintain the indoor temperature at the target indoor temperature input by the user for a specific time. Target indoor temperature data for the deep sleep mode is set to maintain the reduced indoor temperature for a specific time so that the user can maintain their healthy body/skin temperature when they sleep in winter and then to gradually increase the indoor temperature to the target indoor temperature input by the user for the remaining time of the deep sleep mode. Finally, if the sleep operation is terminated and the user wakes up, then their body temperature is low and their metabolic activity is low. Therefore, target indoor temperature data for the waking mode is set to further increase the indoor temperature by a specific level in order to increase the body temperature of the user for a specific time before the sleep operation is terminated.

Figure 4:
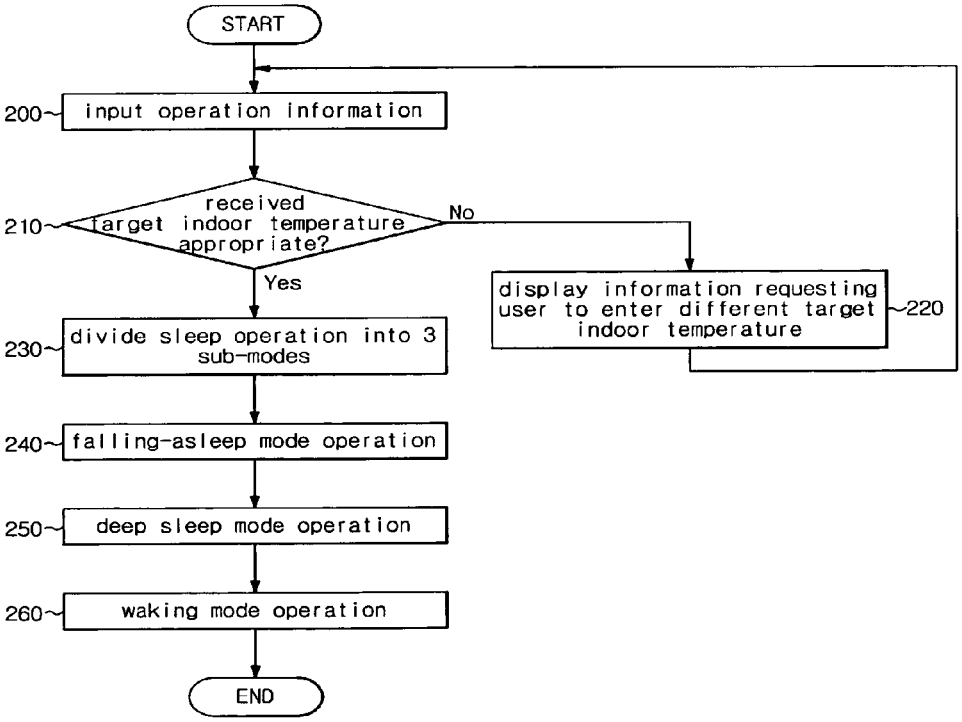
FIG. 4 is a flow chart of a method to control the sleep operation of the air conditioner according to an embodiment of the invention.

A method to control the sleep operation of the air conditioner according to an embodiment of the invention will now be described with reference to FIG. 4.

If the user inputs operation information for the sleep operation such as an operation mode, a sleep operation duration, and a target indoor temperature, the microcomputer 30 receives the input operation information (200).

If the microcomputer 30 receives the operation information in operation 200, the microcomputer 30 determines whether or not the input target indoor temperature is appropriate for the operation mode (210).

If it is determined in operation 210 that the input target indoor temperature is not appropriate for the operation mode, the microcomputer 30 controls the display unit 100 to display information requesting the user to input a different target indoor temperature within a range of 24 to 27° C. in the case of the cooling mode and within a range of 22 to 25° C. in the case of the heating mode (220).

If it is determined in operation 210 that the input target indoor temperature is appropriate for the operation mode, the microcomputer 30 divides an input sleep operation duration into respective operation durations of the three sub-modes, taking into account changes in the body temperature in sleep cycles of human beings (230).

If the sleep operation duration is divided into the respective operation durations of the sub-modes, in the cooling mode, the microcomputer 30 performs a falling-asleep mode to adjust the indoor temperature to be 2° C. lower than the target indoor temperature to allow the user to quickly fall asleep. In the heating mode, the microcomputer 30 performs a falling-asleep mode to adjust the indoor temperature to be 2° C. lower than the target indoor temperature to allow the user to quickly fall asleep after maintaining the indoor temperature at the target indoor temperature for a specific time. In the falling-asleep mode, the microcomputer 30 increases the rotation speed of the fan and the capacity of the compressor 40 to reduce the indoor temperature in a short time. If the indoor temperature is reduced, the skin temperature of the user is also reduced to allow them to easily fall asleep and to fall into a deep sleep in a short time (240).

If the operation duration of the falling-asleep mode is terminated, the microcomputer 30 determines that the user has fallen asleep and performs a deep sleep mode to allow the user to sleep soundly. In the cooling mode, the microcomputer 30 performs a deep sleep mode to periodically repeat an operation to increase the indoor temperature to be 2° C. higher than the target indoor temperature and then to reduce the indoor temperature back to the target indoor temperature. In the heating mode, the microcomputer 30 performs a deep sleep mode to maintain the reduced indoor temperature for a specific time so that the user can maintain their healthy body/skin temperature when they sleep in winter and then to gradually increase the indoor temperature to the target indoor temperature input by the user for the remaining time of the deep sleep mode (250).

If the operation duration of the deep sleep mode is terminated, the microcomputer 30 determines that the waking time of the user has been reached and performs a waking mode. In the cooling mode, the microcomputer 30 performs a waking mode to increase the indoor temperature to be 2.5 or 3° C. higher than the target indoor temperature to increase the body temperature of the user and then terminates the operation. In the heating mode, the microcomputer 30 performs a waking mode to increase the indoor temperature to be 1° C. higher than the target indoor temperature to increase the body temperature of the user and then terminates the operation. Increasing the indoor temperature increases the body temperature of the user and increases the metabolic activity of the user (260).

Figure 5A:
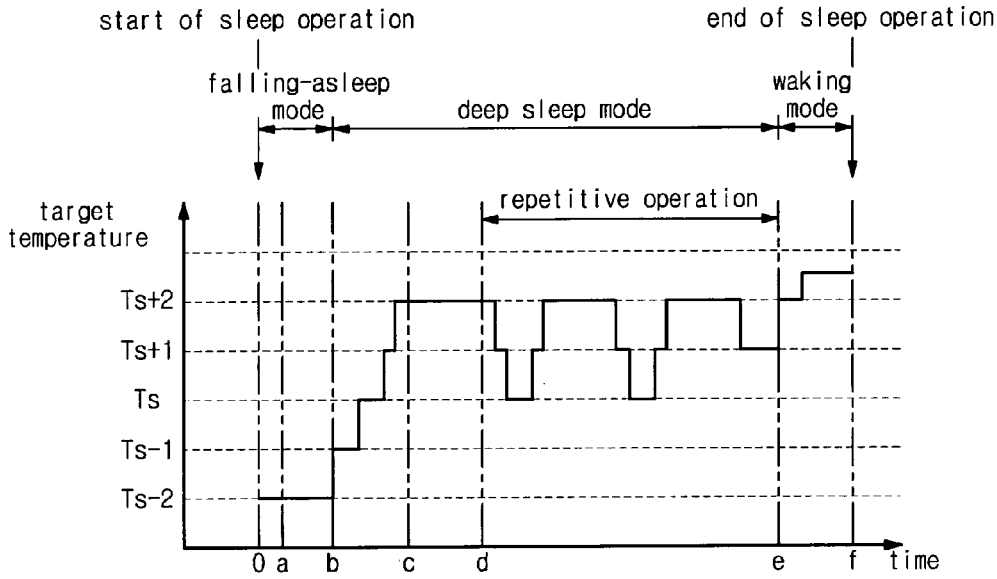
FIG. 5A illustrates changes in a target indoor temperature according to sleep operation timings during cooling operation of the air conditioner according to an embodiment of the invention.
Figure 5B:
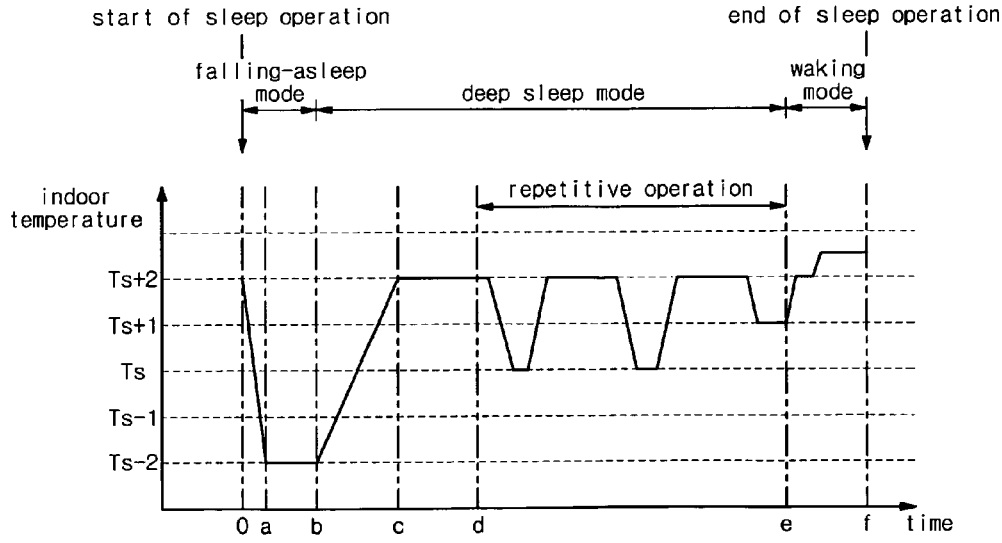
FIG. 5B illustrates changes in an indoor temperature according to sleep operation timings during the cooling operation of FIG. 5A.

Changes in the indoor temperature according to sleep operation timings during cooling operation of the air conditioner according to an embodiment of the invention will now be described with reference to FIGS. 5A and 5B. When the sleep operation starts, the microcomputer 30 causes the air conditioner to uniformly blow out air at a temperature 2° C. lower than the target indoor temperature Ts into the room during a time interval from "0" to "b" as shown in FIG. 5A. The indoor temperature is rapidly reduced during a time interval from "0" to "a". This reduces the skin temperature of the user to an appropriate level, thereby minimizing the activity of their temperature control system. Thereafter, the reduced indoor temperature is maintained constant during a time interval from "a" to "b". This keeps the skin temperature of the user at a lower level to allow the user to fall asleep.

During a time interval from "b" to "c", the microcomputer 30 gradually increases the temperature of discharged air from that of the time interval from "0" to "b" in order to increase the indoor temperature to a level of "Ts+2". Here, the indoor temperature is continuously and gradually increased to prevent a rapid increase in the body/skin temperature. The increased indoor temperature prevents a reduction in the skin temperature to allow the user to sleep soundly. During a time interval from "c" to "e", the microcomputer 30 performs a control operation to increase the indoor temperature to "Ts+2" and then to reduce it to "Ts" in an alternating fashion so that the body/skin temperature is within a comfortable range. Keeping the indoor temperature at the high level "Ts+2" during the time interval from "c" to "e" makes the user feel hot, thereby disturbing their comfortable sleep. Thus, it is necessary to periodically reduce the increased indoor temperature.

During a time interval from "e" to "f", the microcomputer 30 causes the air conditioner to blow out air at a temperature of "Ts+2" into the room for a specific time and then to blow out air at a temperature of "Ts+2.5" or "Ts+3", which is a specific level (i.e., 2 or 3° C.) higher than "Ts+2". Since the user will wake up at the time "f", the microcomputer 30 further increases the indoor temperature by the specific level to increase the body temperature of the user for a specific time before the time "f" (i.e., during the time interval "e" to "f"). The increased body temperature contributes to increasing the metabolic activity of the user.

Figure 6A:
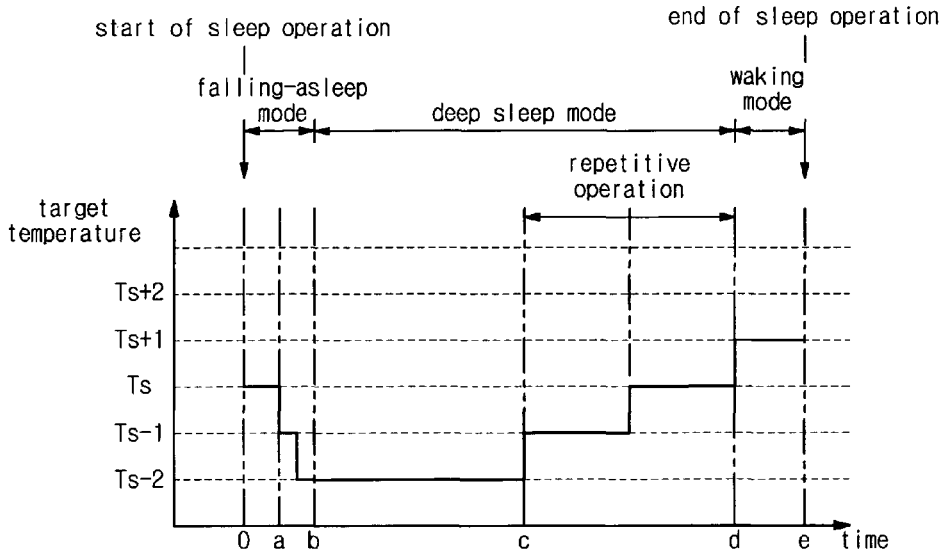
FIG. 6A illustrates changes in a target indoor temperature according to sleep operation timings during heating operation of the air conditioner according to an embodiment of the invention.
Figure 6B:
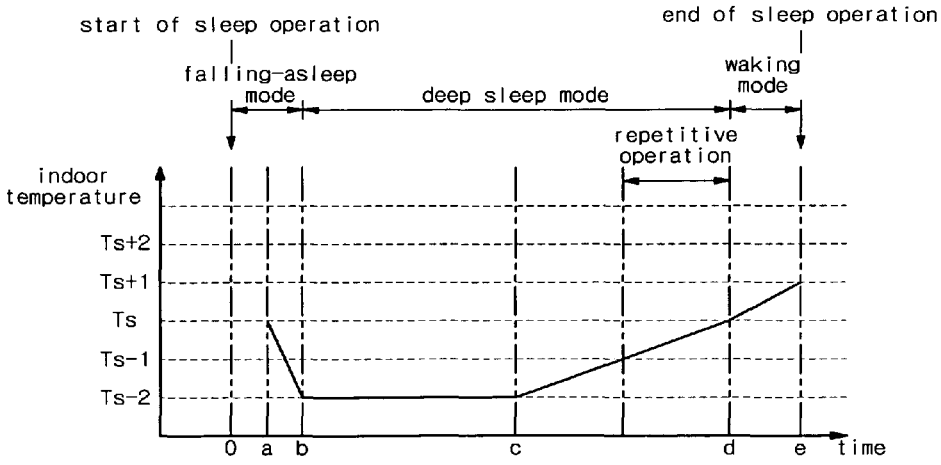
FIG. 6B illustrates changes in an indoor temperature according to sleep operation timings during the heating operation of FIG. 6A.

Changes in the indoor temperature according to sleep operation timings during heating operation of the air conditioner according to an embodiment of the invention will now be described with reference to FIGS. 6A and 6B.

When the sleep operation starts, the microcomputer 30 causes the air conditioner to uniformly blow out air at a target indoor temperature Ts input by the user into the room during a time interval from "0" to "a". This causes the indoor temperature to approach Ts. Thereafter, during a time interval from "a" to "b", the microcomputer 30 gradually decreases the temperature of discharged air to reduce the indoor temperature to "Ts−2". The reduction in the indoor temperature decreases the skin temperature of the user to an appropriate level to minimize the activity of their temperature control system, thereby allowing the user to fall asleep.

During a time interval from "b" to "c", the microcomputer 30 keeps the temperature of discharged air at "Ts−2" to keep the indoor temperature at "Ts−2" so that the user can maintain their healthy body/skin temperature when they sleep in winter. During a time interval from "c" to "d", the microcomputer 30 periodically increases the temperature of discharged air to gradually increase the indoor temperature to "Ts". The gradual increase in the indoor temperature prevents a rapid increase in the body/skin temperature and the increased indoor temperature prevents a reduction in the skin temperature to allow the user to sleep soundly. Then, during a remaining time of the sleep operation, the microcomputer 30 periodically repeats an operation to reduce the temperature of discharged air back to "Ts−1" and then to increase the indoor temperature back to "Ts", thereby allowing the body/skin temperature to be within a comfortable range.

During a time interval from "d" to "e", the microcomputer 30 increases the temperature of discharged air to "Ts+1" to increase the indoor temperature to "Ts+1". Since the user will wake up at the time "e", the microcomputer 30 further increases the indoor temperature by the specific level to increase the body temperature of the user for a specific time before the time "e" (i.e., during the time interval "d" to "e"). The increased body temperature contributes to increasing the metabolic activity of the user.

As is apparent from the above description, the present invention provides a method to control a sleep operation of an air conditioner with a variety of advantages. For example, the indoor temperature is adjusted according to changes in the body temperature and sleep cycles of human beings, thereby allowing the user to sleep soundly.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method to control a sleep operation of an air conditioner when the air conditioner is in cooling operation, the method comprising:

determining whether or not a sleep operation is activated; and sequentially performing a plurality of sub-modes of the sleep operation if the sleep operation is activated, wherein the plurality of sub-modes include a falling-asleep mode to reduce an indoor temperature to be lower than a target indoor temperature by a first level and a waking mode to increase the indoor temperature to be higher than the target indoor temperature by a second level, and the plurality of sub-modes further include a deep sleep mode to increase the indoor temperature to be higher than the target indoor temperature by a third level and then to reduce the indoor temperature back to at least the target indoor temperature periodically.

2. The method according to claim 1, wherein the plurality of sub-modes further include a deep sleep mode to increase the indoor temperature to the target indoor temperature after maintaining the indoor temperature at a level, which is lower than the target indoor temperature by the first level, during a heating operation.

3. The method according to claim 2, wherein the deep sleep mode includes repeating an operation to reduce the indoor temperature back to a temperature, which is lower than the target indoor temperature by the second level, and then to increase the indoor temperature back to the target indoor temperature.

4. The method according to claim 1, wherein an operation duration of the deep sleep mode is determined according to a duration of the sleep operation.

5. The method according to claim 1, wherein the second level is higher than the first level during a cooling operation.

6. The method according to claim 1, wherein, in the falling-asleep mode during a cooling operation, when a sleep operation command is input, the air conditioner immediately operates with a temperature which is lower than the target indoor temperature by the first level.

7. The method according to claim 1, wherein the second level is lower than the first level during a heating operation.

8. The method according to claim 1, wherein, in the falling-asleep mode during a heating operation, when a sleep operation command is input, the air conditioner operates with the target indoor temperature for a specific period of time and then operates at a temperature which is lower than the target indoor temperature by the first level.

9. The method according to claim 2, wherein an operation duration of the deep sleep mode is determined according to a duration of the sleep operation.

10. A method to control a sleep operation of an air conditioner when the air conditioner is in cooling operation, the method comprising:

maintaining an indoor temperature during a falling-asleep mode comprising maintaining the indoor temperature below a target indoor temperature until a first reference time elapses after the sleep operation starts;

increasing the indoor temperature during a deep sleep mode comprising increasing, after the first reference time elapses, the indoor temperature to be higher than the target indoor temperature and then reducing the indoor temperature back to the target indoor temperature periodically; and maintaining the indoor temperature during a waking mode comprising maintaining the indoor temperature above the target indoor temperature for a second reference time before the sleep operation is terminated.

11. The method according to claim 10, wherein the first reference time is at least 1 hour and the second reference time is at least 1 hour.

12. The method according to claim 10, wherein the target indoor temperature is set within a range from 24° C. to 27° C.

13. The method according to claim 10, further comprising maintaining the indoor temperature below the target indoor temperature by 2° C. until the first reference time elapses from the start of the sleep operation, increasing the indoor temperature to be 2° C. higher than the target indoor temperature and then reducing back to the target indoor temperature periodically after the first reference time elapses, and maintaining the indoor temperature above the target indoor temperature by 2.5-3° C. for the second reference time before the sleep operation is terminated.

14. A non-transitory computer-readable medium storing computer executable instructions which, when executed by the air conditioner, causes the air conditioner to perform a method comprising:

when the air conditioner is in cooling operation, determining whether or not a sleep operation is activated; and sequentially performing a plurality of sub-modes of the sleep operation if the sleep operation is activated, wherein the plurality of sub-modes include a falling-asleep mode to reduce an indoor temperature to be lower than a target indoor temperature by a first level and a waking mode to increase the indoor temperature to be higher than the target indoor temperature by a second level, and the plurality of sub-modes further include a deep sleep mode to increase the indoor temperature to be higher than the target indoor temperature by a third level and then to reduce the indoor temperature back to at least the target indoor temperature periodically.

15. An air conditioner programmed to perform a method comprising:

when the air conditioner is in cooling operation, determining whether or not a sleep operation is activated; and sequentially performing a plurality of sub-modes of the sleep operation if the sleep operation is activated, wherein the plurality of sub-modes include a falling-asleep mode to reduce an indoor temperature to be lower than a target indoor temperature by a first level and a waking mode to increase the indoor temperature to be higher than the target indoor temperature by a second level, and the plurality of sub-modes further include a deep sleep mode to increase the indoor temperature to be higher than the target indoor temperature by a third level and then to reduce the indoor temperature back to at least the target indoor temperature periodically.

16. The method according to claim 1, wherein the first level is at least 2° C. and the third level is at least 2° C.

17. The method according to claim 16, wherein during the waking mode, the indoor temperature is maintained at least 1° C. above the target indoor temperature.

18. A non-transitory computer-readable medium storing computer executable instructions which, when executed by the air conditioner, causes the air conditioner to perform the method recited in claim 10.

19. An air conditioner programmed to perform the method recited in claim 10.

20. A method to control a sleep operation of an air conditioner when the air conditioner is in heating operation, the method comprising:

executing a falling-asleep mode by maintaining an indoor temperature below a target indoor temperature by a first level until a first reference time elapses after the sleep operation starts, the first reference time being at least 1 hour;

executing a first stage of a deep sleep mode after the falling-asleep mode is terminated by maintaining the indoor temperature to be below the target indoor temperature by the first level until a second reference time elapses after the first stage of the deep sleep mode starts;

executing a second stage of the deep sleep mode after elapse of the second reference time by increasing the indoor temperature in an incremental manner to the target indoor temperature; and executing a waking mode after the deep sleep mode is terminated by increasing the indoor temperature above the target indoor temperature for a third reference time before the sleep operation is terminated.

21. The method according to claim 20, wherein the target indoor temperature is set within a range from 22° C. to 25° C.

22. The method according to claim 20, wherein the first level is at least 2° C.

23. The method according to claim 20, wherein during the waking mode, the indoor temperature is maintained at least 1° C. above the target indoor temperature for the third reference time.

24. A non-transitory computer-readable medium storing computer executable instructions which, when executed by the air conditioner, causes the air conditioner to perform a method comprising:

when the air conditioner is in heating operation, executing a falling-asleep mode by maintaining an indoor temperature below a target indoor temperature by a first level until a first reference time elapses after the sleep operation starts, the first reference time being at least 1 hour;

executing a first stage of a deep sleep mode after the falling-asleep mode is terminated by maintaining the indoor temperature to be below the target indoor temperature by the first level until a second reference time elapses after the first stage of the deep sleep mode starts;

executing a second stage of the deep sleep mode after elapse of the second reference time by increasing the indoor temperature in an incremental manner to the target indoor temperature; and executing a waking mode after the deep sleep mode is terminated by increasing the indoor temperature above the target indoor temperature for a third reference time before the sleep operation is terminated.

25. An air conditioner programmed to perform a method comprising:

when the air conditioner is in heating operation, executing a falling-asleep mode by maintaining an indoor temperature below a target indoor temperature by a first level until a first reference time elapses after the sleep operation starts, the first reference time being at least 1 hour;

executing a first stage of a deep sleep mode after the falling-asleep mode is terminated by maintaining the indoor temperature to be below the target indoor temperature by the first level until a second reference time elapses after the first stage of the deep sleep mode starts;

executing a second stage of the deep sleep mode after elapse of the second reference time by increasing the indoor temperature in an incremental manner to the target indoor temperature; and executing a waking mode after the deep sleep mode is terminated by increasing the indoor temperature above the target indoor temperature for a third reference time before the sleep operation is terminated.

* * * * *

UNITED STATES PATENT AND TRADEMARK OFFICE

CERTIFICATE OF CORRECTION

PATENT NO. : 8,146,833 B2
APPLICATION NO. : 11/937757
DATED : April 3, 2012
INVENTOR(S) : Myung Seob Song et al.

It is certified that error appears in the above-identified patent and that said Letters Patent is hereby corrected as shown below:

Title page Column 2 (Other Publications), Line 2, Delete "No." and insert -- No.: --, therefor.

Column 1, Line 9, Delete "Office," and insert -- Office, and Korean Patent Application No. 10-2007-0112564, filed November 6, 2007 in the Korean Intellectual Property Office, --, therefor.

Column 1, Line 9, Delete "disclosure" and insert -- disclosures --, therefor.

Signed and Sealed this
Twelfth Day of June, 2012

David J. Kappos

David J. Kappos
*Director of the United States Patent and Trademark Office*